US009857053B2

(12) United States Patent
Hsia

(10) Patent No.: US 9,857,053 B2
(45) Date of Patent: Jan. 2, 2018

(54) SOLID-STATE LIGHTING LUMINAIRE WITH A UNIFORM ILLUMINATION OUTPUT

(71) Applicant: Aleddra Inc., Renton, WA (US)

(72) Inventor: Chungho Hsia, Bellevue, WA (US)

(73) Assignee: ALEDDRA INC., Renton, WA (US)

( * ) Notice: Subject to any disclaimer, the term of this patent is extended or adjusted under 35 U.S.C. 154(b) by 73 days.

(21) Appl. No.: 15/071,336

(22) Filed: Mar. 16, 2016

(65) Prior Publication Data

US 2017/0268744 A1 Sep. 21, 2017

(51) Int. Cl.

| | |
|---|---|
| ***F21S 4/00*** | (2016.01) |
| ***F21V 5/04*** | (2006.01) |
| ***F21S 8/04*** | (2006.01) |
| ***F21V 3/02*** | (2006.01) |
| ***F21V 7/00*** | (2006.01) |
| *F21Y 115/10* | (2016.01) |
| *F21Y 103/10* | (2016.01) |

(52) U.S. Cl.

CPC ..... *F21V 5/04* (2013.01); *F21S 8/04* (2013.01); *F21V 3/02* (2013.01); *F21V 7/0025* (2013.01); *F21Y 2103/10* (2016.08); *F21Y 2115/10* (2016.08)

(58) Field of Classification Search

CPC .. F21V 5/04; F21V 3/02; F21V 7/0025; F21S 8/04; F21Y 2103/10; F21Y 2115/10

See application file for complete search history.

(56) References Cited

U.S. PATENT DOCUMENTS

| | | | | |
|---|---|---|---|---|
| 2014/0226305 | A1* | 8/2014 | Kim | F21S 2/00 362/84 |
| 2015/0049476 | A1* | 2/2015 | Hsia | F21S 8/00 362/223 |
| 2015/0362132 | A1* | 12/2015 | McCane | F21K 9/90 362/235 |

* cited by examiner

*Primary Examiner* — Laura Gudorf

(74) *Attorney, Agent, or Firm* — Han IP Corporation

(57) ABSTRACT

A light-emitting diode (LED) luminaire adopts LED light sources (LEDs) and a corrugated light exit window. Light rays emitting at different angles from the LEDs launch onto the corrugated light exit window with numerous light images of the LEDs. The light images are so heavily overlapped that smooth out hot spots with dark spots, an effect of averaging, creating a uniform illumination output. The LED luminaire is capable of averaging white light emissions from a plurality of LEDs, mixing light emissions from various white LEDs at different correlated color temperatures (CCTs), or mixing light emissions from various white LEDs at a specific CCT with emissions from LEDs having saturated colors, rendering a uniform illumination with a consistent intensity or color hue within viewing angles.

13 Claims, 6 Drawing Sheets

SOLID-STATE LIGHTING LUMINAIRE WITH A UNIFORM ILLUMINATION OUTPUT

TECHNICAL FIELD

The present disclosure relates to a light-emitting diode (LED) luminaire, and more particularly to a luminaire that adopts LED light sources with a lens comprising a corrugated structure used to sufficiently mix and uniform light emissions from various LED light sources with consistent intensity and color hue within viewing angles and improved aesthetic perception.

BACKGROUND

Solid-state lighting from semiconductor light-emitting diodes (LEDs) has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, more energy saving, more efficient correlated color temperature (CCT) tunability, and more aesthetic perception in lighting quality have become especially important and need to be well addressed.

In a retrofit application of a linear LED tube lamp to replace an existing fluorescent tube, the lamp is so configured that the light coming out from the LED light sources illuminates a target area directly. The shortcomings are pixilation, glare, and not enough cut-off at vertical angles greater than 80° above the lamp nadir, which cause users' eyes uncomfortable, thus affecting their mood. Similarly, many conventional LED luminaires adopt direct illumination approach and show a poor lighting quality such as hot and dark spots and shadows.

A conventional 2 by 2 feet panel light troffer uses a square thick acrylic plate as a light diffusing medium. LED light sources located at four lateral sides of the acrylic plate illuminate the four sides of the plate, and evanescent light waves exiting from the front face of the acrylic plate further scatter through a plastic diffuser attached to the acrylic plate in the front panel before launching into a target area. In order to increase optical efficiency, the back panel of the panel light troffer is attached with a reflective sheet. However, such panel light troffers have their light opening flushed with T-bar ceiling grids without recess. Thus, occupants in the room can see the whole bare bright area 2 by 2 feet and feel uncomfortable because a direct glare affects their eyes and thus distracts them.

In today's lighting applications, correlated color temperature (CCT) tuning is important. Although consumers demand a tunable CCT such as warm-white at 2,700 K, sun-white, natural-white, or cool-white at 6,200±300 K in lighting to help improve the atmosphere in working, exhibiting, or living areas, there have been very few such lighting products in the troffer and luminaire markets. The LED panel light troffers do not have a proper structure to sufficiently perform spatial color mixing, which makes it difficult to be successful on the market. Instead, manufacturers can generally make an LED troffer using two kinds of phosphor coated white LEDs, one cool white and the other warm white, to mix the light emissions with different ratios to come up with desired color temperatures. Because at the two color extremes, only one kind of LEDs emits the light, such troffers have poor cost efficiency and luminous efficacy. In spite of these disadvantages, the approach is one of several solutions to changing CCT of an LED troffer in general lighting applications. However, the approach needs a proper color mixing scheme to smooth out lighting outputs such that the color hue is consistent within viewing angles.

Other possible color temperature tuning approaches include a white LED at CCT of 6,200±300 K mixed with an LED having a saturated color, featuring high luminous efficacy; a yellow white LED mixed with a red LED; and RGB color mixing, the earliest approach to varying light color, in which white light is perceived where all three additive primaries overlap. Because of low luminous efficacy and difficulty to meet CIE 1931 recommendations for general lighting in solid state lighting products, such as stabilizing a specific chromaticity over time while LED junction temperatures change from ambient temperature to 120° C. or higher due to different thermal dependencies for an individual LED, the RGB approach is seldom adopted as in general lighting applications today. However, in decorative lighting, RGB color mixing is frequently used. By varying the intensities of the individual red, green, and blue light sources, any colors that human eyes can perceive can be obtained. Surely, in all of the above mentioned CCT tuning approaches, many of same or different LEDs need to be used in combination to achieve a required lumen output. Thus uniformity of the resultant CCT light and color hue within viewing angles becomes an issue if the troffer or luminaire used cannot provide adequate light averaging and mixing functions.

Emergency lighting is especially important in this consumerism era. The emergency lighting systems in retail sales and assembly areas with an occupancy load of 100 or more are required by codes in many cities. Occupational Safety and Health Administration (OSHA) requires that a building's exit paths be properly and automatically lighted at least ninety minutes of illumination at a minimum of 10.8 lux so that an employee with normal vision can see along the exit route after the building power becomes unavailable. This means that emergency egress lighting must operate reliably and effectively during low visibility evacuations. To ensure reliability and effectiveness of backup lighting, building owners should abide by the National Fire Protection Association's (NFPA) emergency egress light requirements that emphasize performance, operation, power source, and testing. OSHA requires most commercial buildings to adhere to the NFPA standards or a significant fine. Meeting OSHA requirements takes time and investment, but not meeting them could result in fines and even prosecution. If a building has egress lighting problems that constitute code violations, the quickest way to fix is to replace the existing troffer with a multi-function LED troffer that has an emergency light package integrated with the normal lighting. The code also requires the emergency lights be inspected and tested periodically on site to ensure they are in proper working conditions at all times.

It is, therefore, the manufacturers' responsibility to design an LED luminaire not only with a uniform illumination output but also with an emergency LED module integrated such that after the LED luminaire is installed on a ceiling, the emergency LED module can individually be inspected, without removing the whole luminaire from the ceiling. Such designs can improve lighting quality and greatly reduce lifetime cost of ownership. Currently no manufacturers have adopted such a cost-effective approach in a luminaire used to replace conventional fixtures for fluorescent lamps.

SUMMARY

The present disclosure relates to LED luminaires that adopt LED light strips mounted on a flat mount surface of a luminaire body. The LED light strips are substantially covered by a curved light exit window with a surface of corrugated, long, narrow cuts. Light rays emitting at different angles from the LEDs launch onto the curved light exit window, an imperfect reflecting diffuser, with numerous light images of the LEDs on the surface of corrugated, long, narrow cuts. The light images are so heavily overlapped that smooth out hot spots with dark spots on the light exit window, an effect of averaging, creating a uniform illumination output. The LED luminaire can sufficiently average light emissions not only from various white LEDs but also from integrated RGB LEDs mounted on the LED light strips without dark or hot spots and shadow appeared on the curved light exit window. In another embodiment, such a luminaire uses the said light exit window to sufficiently mix light emissions from white LEDs having a CCT at 6,200±300 K and color light emissions from LEDs having saturated colors to generate tunable CCT light outputs with a uniform illumination output.

The LED luminaires adopting such a curved light exit window have an additional advantage. The corrugated structure of the curved light exit window makes it rigid enough in its lengthwise direction while flexible enough in its widthwise direction so that the curved light exit window can be easily mounted on or removed from the luminaire through a securing mechanism in the luminaire. This feature makes it possible that an emergency backup system can be installed in the field and periodically inspected on site according to city codes. Thus, an additional linear LED light strip may be further mounted on the central elongated region of the flat surface portion as an emergency light, illuminating directly to a target area through the same curved light exit window as used in the normal light. The emergency LED light strip with a test switch concealed in an interior cavity of the luminaire will be lighted only when alternating-current (AC) mains are unavailable. The multi-function design shares a common optical system and integrates normal and emergency light systems in an LED luminaire, not only saving space but also increasing aesthetic perception of emergency light.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Figure 1:
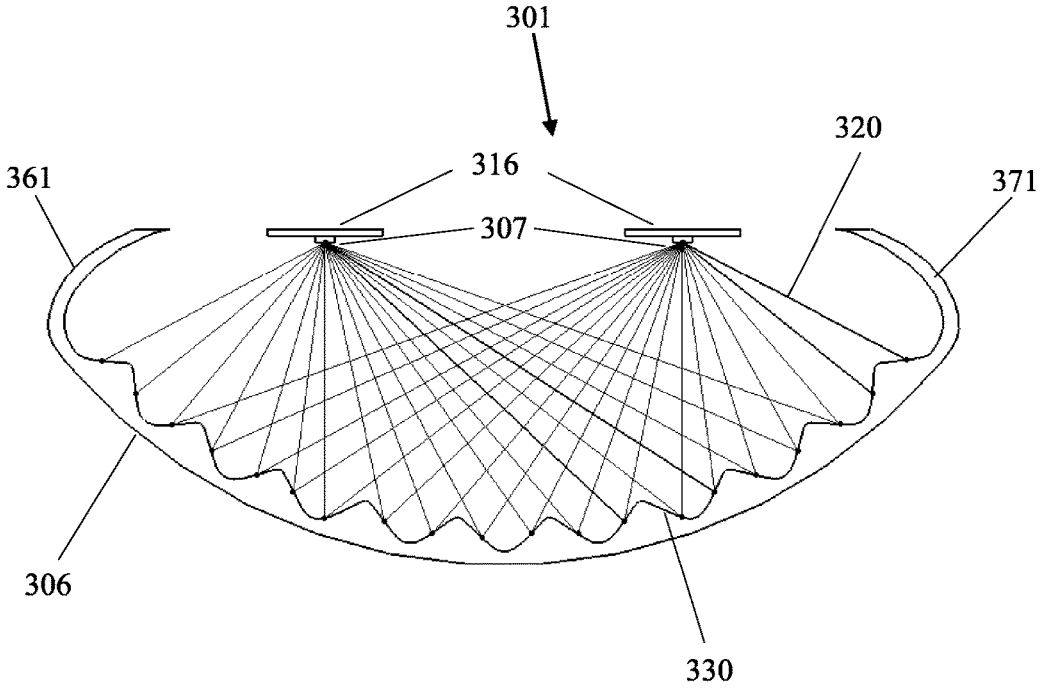
FIG. 1 is an illustration of some light rays emitting from LEDs in an LED module of an LED luminaire according to the present disclosure.

FIG. 1 is an illustration of some light rays emitting from LEDs in an LED module of an LED luminaire according to the present disclosure. The LED module 301 comprises two LED light strips 316 each with a plurality of LEDs 307 and a light exit window 306 with a convex lens covering all the lighting flux of the LEDs 307. On the interior surface of the light exit window 306 is a corrugated structure with long, narrow cuts. Light rays 320 emitting at different angles from the LEDs 307 launch onto the light exit window 306 with numerous light images of the LEDs 307. The light images are so heavily overlapped that smooth out hot spots with dark spots, an effect of averaging, creating a uniform illumination output. In other words, FIG. 1 illustrates some of the light rays 320 that lunch onto the light exit window 306 at numerous spots on the corrugated interior surface 330 as if such numerous light spots are uniformly distributed on the light exit window 306. In combination, the resultant light distribution out of the light exit window 306 becomes uniform with consistent intensity and color hue within viewing angles. For an illustration purpose, the corrugated structure on the interior surface of the light exit window 306 is purposely made large. However, a period of the corrugated structure may be in an order of or smaller than dimensions of the LEDs used, to be effective. On the two sides of the light exit window 306 are two small hanging portions 361 and 362 that receive a small percentage of light emissions but can be used to hold the light exit window 306 in an LED luminaire. See following paragraphs for details.

Figure 2:
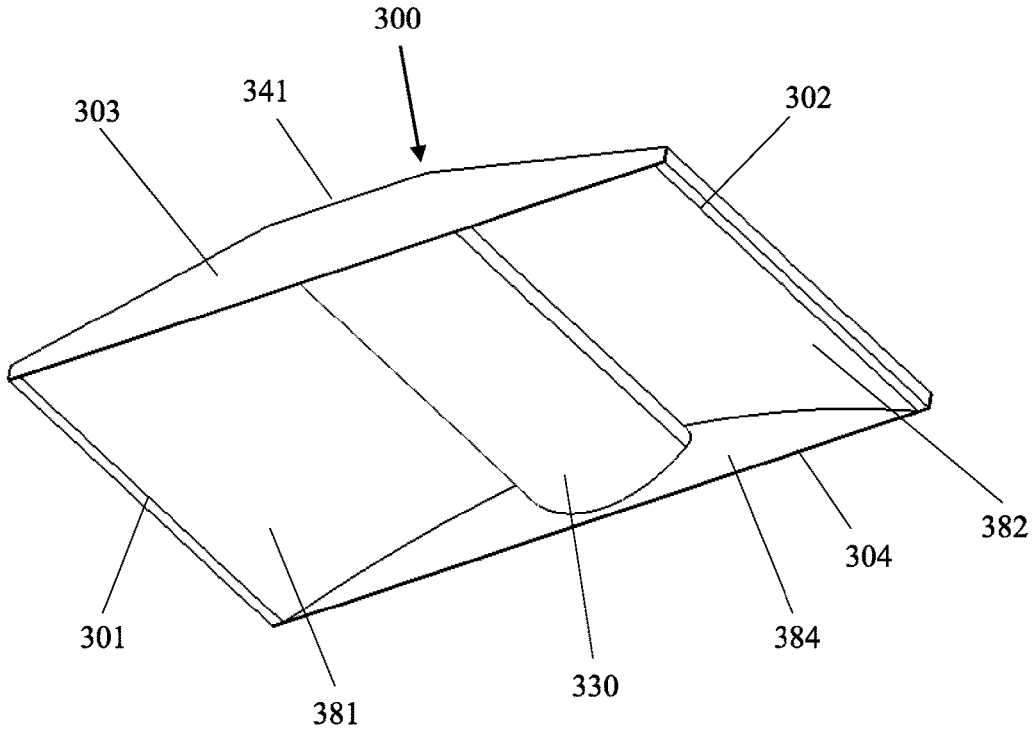
FIG. 2 is a front-bottom perspective view of an LED luminaire according to the present disclosure.
Figure 3:
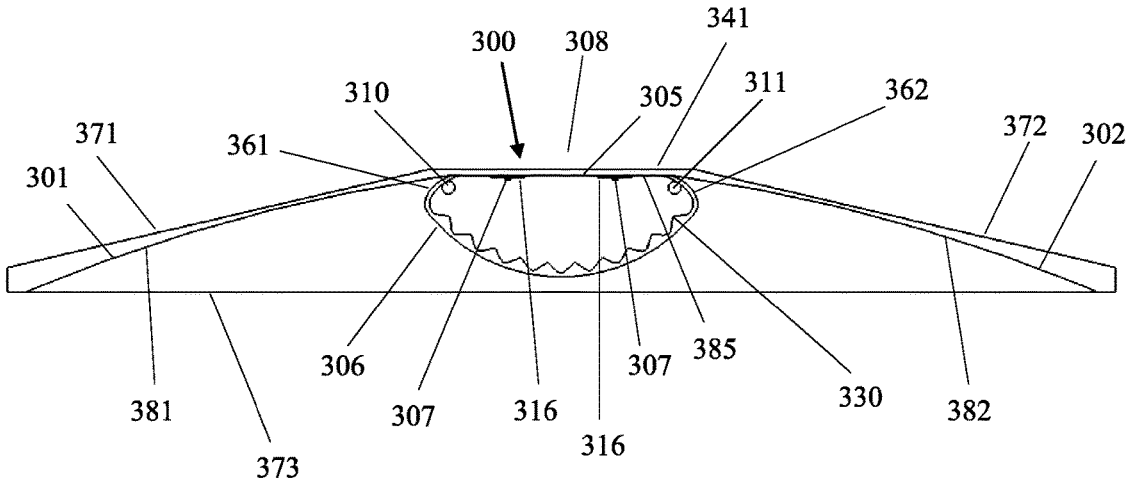
FIG. 3 is a front view of an LED luminaire according to the present disclosure.
Figure 4:
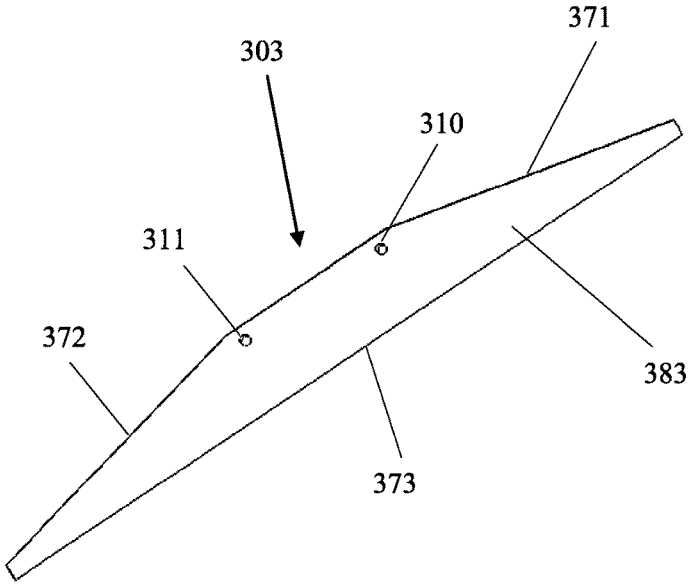
FIG. 4 is a front-bottom perspective view of an end surface portion in an LED luminaire according to the present disclosure.

FIG. 2 is a front-bottom perspective view of an LED luminaire adopting the LED module in FIG. 1. FIG. 3 is a front view of the LED luminaire in FIG. 2. FIG. 4 is a front-bottom perspective view of an end surface portion used in an LED luminaire. Referring to FIGS. 1-4, an LED luminaire 300 comprises a body. The body comprises the following: an internal surface comprising two side surface portions 301 and 302; two end surface portions 303 and 304; and a central flat mount surface portion 305 connected to the two side surface portions 301 and 302 and the two end surface portions 303 and 304. The two side surface portions 301 and 302 are symmetrically arranged about a central vertical plane 308. On the internal surface of the body is a reflector. The reflector comprises the following: two side reflectors 381 and 382 on the two side surface portions 301 and 302; an upper reflector 385 (as shown in FIG. 3) on the central flat mount surface portion 305, connected in between the two side reflectors 381 and 382; and two end reflectors 383 (as shown in FIG. 4) and 384 (as shown in FIG. 2) on the two end surface portion 303 and 304. The upper reflector 385 is at an angle in a range from 90° to 180° relative to the two side reflectors 381 and 382. In fact, there is a reflection coating on the two side surface portions 301 and 302, the two end surface portions 303 and 304, and the central flat mount surface portion 305, which allows the two side reflectors 381 and 382, the two end reflectors 383 and 384, and the upper reflector 385 to have a high light reflection for the internal surface of the body. Furthermore, the reflector comprises an imperfect reflecting diffuser with a white reflection material having 8% absorption or less. In some embodiments, the LED luminaire 300 further comprises the LED module 301 mentioned in FIG. 1. The LED module 301 comprises the two LED light strips 316 mounted on the central flat mount surface portion 305 in a lengthwise direction and the light exit window 306 substantially covering the two LED light strips 316. Each of the LED light strips 316 comprises the plurality of LEDs 307 thereon. Thus, the internal surface of the body and the light exit window 306 define an interior cavity symmetric with respect to a vertical plane 308 passing through a center line of the internal surface. On the interior surface 330 of the light exit window 306 are the corrugated structure along a widthwise direction and the long, narrow cuts along a lengthwise direction. The light exit window 306 having a thin, convex shape is so designed that the light emissions from LEDs 307 on the two LED light strips 316 launching onto the light exit window 306 at numerous spots on the corrugated interior surface 330 appear individual light images of the LEDs.

The LED luminaire 300 adopting such a light exit window 306 with the thin, convex shape have an additional advantage. The corrugated structure along a widthwise direction and long narrow cuts along a lengthwise direction of the light exit window 306 makes it rigid enough in its lengthwise direction while flexible enough in its widthwise direction so that the thin, convex light exit window can be squeezed to deform in the widthwise direction, which helps a user install or remove the light exit window 306 on or from the LED luminaire 300. The corrugated structure along a widthwise direction also helps to enhance rigidity in the lengthwise direction of the light exit window 306 so that the light exit window 306 can be secured in a designated place of the LED luminaire 300. A possible securing mechanism can be simply four short bars 5-10 mm long, two protruding from each of the two end surface portions 303 and 304. FIG. 4 shows the end surface portion 303 that comprises two short bars 310 and 311 and edges 371, 372, and 373. Similarly, the other end surface portion 304 comprises another two short bars. In FIG. 3, the end surface portion except the short bars is made transparent for an illustration purpose. However, the edges 371, 372, and 373 of the end surface portion 303 are shown. Two short bars 310 and 311 on the end surface portion 303 are used together with the two short bars on the end surface portion 304 to hold and secure the light exit window 306 by hanging the two small hanging portions 361 and 362 on the light exit window 306 on the four short bars. Thus, the rigidity in the lengthwise direction of the light exit window 306 helps secure the light exit window 306 in place, no risk to fall out of the short bars due to warping over time especially when the LED luminaire 300 and the light exit window 306 are 2, 3, 4 feet long or longer.

These features make it possible that an emergency backup system can be installed in the field and periodically inspected on site according to city codes. In such an embodiment, an additional emergency LED light strip is further mounted on the central elongated region of the central flat mount surface portion 305, preferably symmetric about the two LED light strips 316, illuminating directly to a target area through the same light exit window 306 as used in the normal light illumination. In this case, the emergency LED light strip with a test switch can be mounted in an interior cavity of the luminaire and concealed by the light exit window 306. The multi-function design shares a common optical system and integrates normal and emergency light systems in an LED luminaire, not only saving space but also increasing aesthetic perception of the emergency light. Although nothing is shown on the top area 341 of the central flat mount surface 305, there should be something, for example, a driver that powers the LEDs 307, a box that comprises such a driver, or a part of a luminaire base integrated into the luminaire. However, the driver may or may not be mounted on the top area 341 of the central flat mount surface 305.

Figure 5:
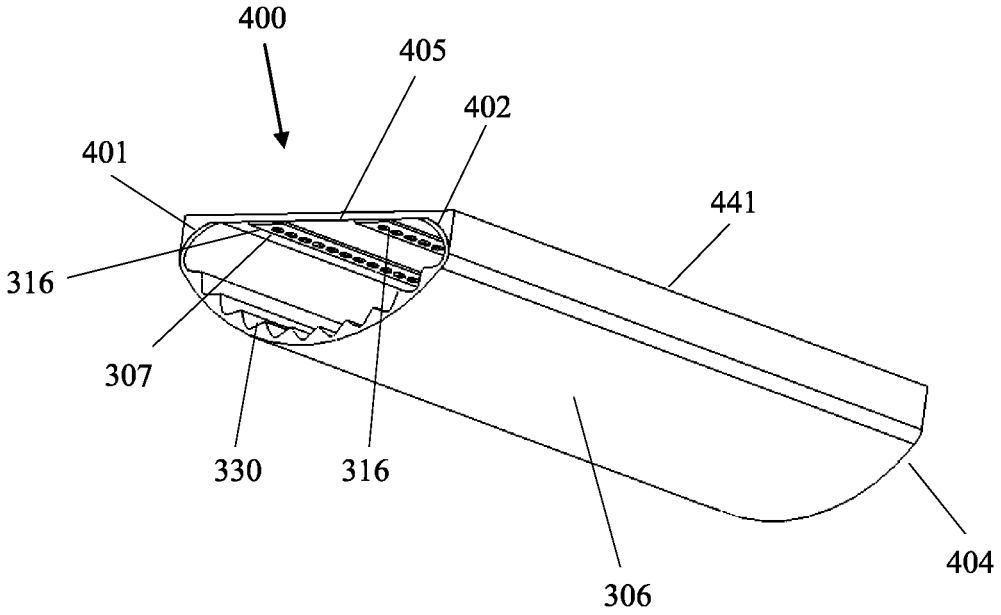
FIG. 5 is a front-bottom perspective view of another embodiment of an LED luminaire according to the present disclosure.

FIG. 5 is a front-bottom perspective view of another embodiment of an LED luminaire according to the present disclosure. FIG. 5 is a front view of the LED luminaire in FIG. 4. In FIGS. 4 and 5, an LED luminaire 400 comprises a body having an internal surface comprising two side surface portions 401 and 402, two end surface portions 403 (not shown) and 404, and a central flat mount surface portion 405 connected to the two side surface portions 401 and 402 and the two end surface portions 403 and 404. The two side surface portions 401 and 402 are symmetrically arranged about a central vertical plane 408. On the internal surface of the body is a reflector comprising two side reflectors on the two side surface portions 401 and 402; an upper reflector on the central flat mount surface 405, connected in between the two side reflectors; and two end reflectors on the two end surface portions 403 and 404, wherein the upper reflector is at an angle in a range from 90° to 180° relative to the two side reflectors. Same as in FIG. 2, there is a reflection coating on the side surface portions 401 and 402, two end surface portions 403 and 404, and the central flat mount surface portion 405, which makes such a reflector to have a high light reflection for the internal surface of the body. The same numerals will be used in FIGS. 5 and 6 for the same components. The LED luminaire 400 further comprises two LED light strips 316 mounted on the central flat mount surface 405 in a lengthwise direction and a light exit window 306 substantially covering the two LED light strips 316. On the interior surface of the light exit window 306, there are a corrugated structure along a widthwise direction and long, narrow cuts along a lengthwise direction. The light exit window 306 is so designed that the light emissions from LEDs 307 on the two LED light strips 316 launching onto the light exit window 306 at numerous spots on the corrugated interior surface appear individual light images of the LEDs. Same as in FIGS. 2 and 3, the two LED light strips 316 are mounted along lengthwise direction of the LED luminaire 400, and the long, narrow cuts of the corrugated structure 330 of the light exit window 306 are aligned along the same direction as the two LED light strips 316 in FIG. 5. Same as the LED luminaire 300 in FIGS. 2 and 3, on the top area 441 of the central flat mount surface 405 may be a driver that powers LEDs, a box that comprises such a driver, or a part of a luminaire base integrated into the luminaire. However, the driver may or may not be mounted on top area 441 of the central flat mount surface 405.

Unlike some prior art devices that need multiple reflections to uniform the beams emitted from multiple light sources, the LED luminaire 300 or 400 according to the present disclosure are so designed that most of the luminous flux in all directions emitted from the LEDs 307 goes through the light exit window 306 to increase optical efficiency, while maintaining the uniformity much better than 3:1, or even 2:1. The combined structure and the diffuser nature of the light exit window and the reflector ensures the mixing to be sufficient enough so as to well perform light averaging with a uniform illumination output not only for same white LEDs and red, green, and blue (RGB) LEDs but also for color mixing of different white LEDs or white LEDs with color LEDs for a tunable white light. Besides, the luminance is modified from bright, uncomfortable point sources to a much larger, softer diffused light. Thus, a coarse luminance gradient worse than 10:1 in a conventional direct-illumination luminaire that requires heavy diffusers to improve can be overcome with much less aggressive diffusers achieving max/min ratios of 3:1, or even 2:1. Although the two LED luminaires 300 and 400 in FIGS. 2 and 3 as well as FIGS. 5 and 6 comprise just two side reflectors, the reflector used in the LED luminaires 300 and 400 should not be limited to these configurations only. For example, the two side reflectors may comprise multiple sub-reflectors. The reflector may be formed by a single or multiple concave shapes.

Figure 6:
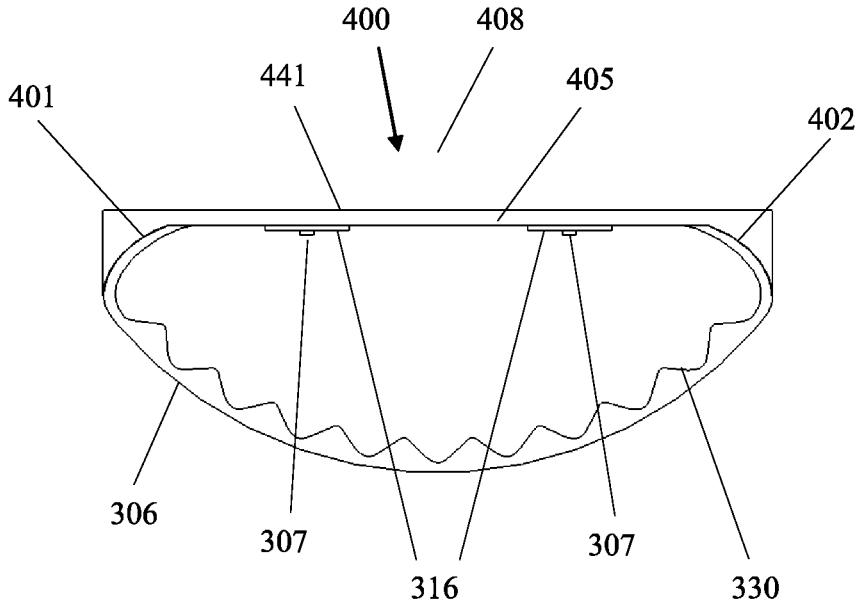
FIG. 6 is a front view of an LED luminaire in FIG. 4 according to the present disclosure.

In FIGS. 2 and 3 as well as FIGS. 5 and 6, the reflectors comprise a diffuser with a white reflective material that has 8% absorption or less. One way to achieve this is by using a reflective coating with a white paint mixed with a strongly reflective powder that has a refractive index greater than 1.9. The light exit window 306 may comprise a diffuser with volumetric material, a prismatic lens structure, or a lens with diffraction gratings, a random or regular geometric pattern, or simply a frosted diffusive inlay on the interior of the light exit window.

Figure 7:
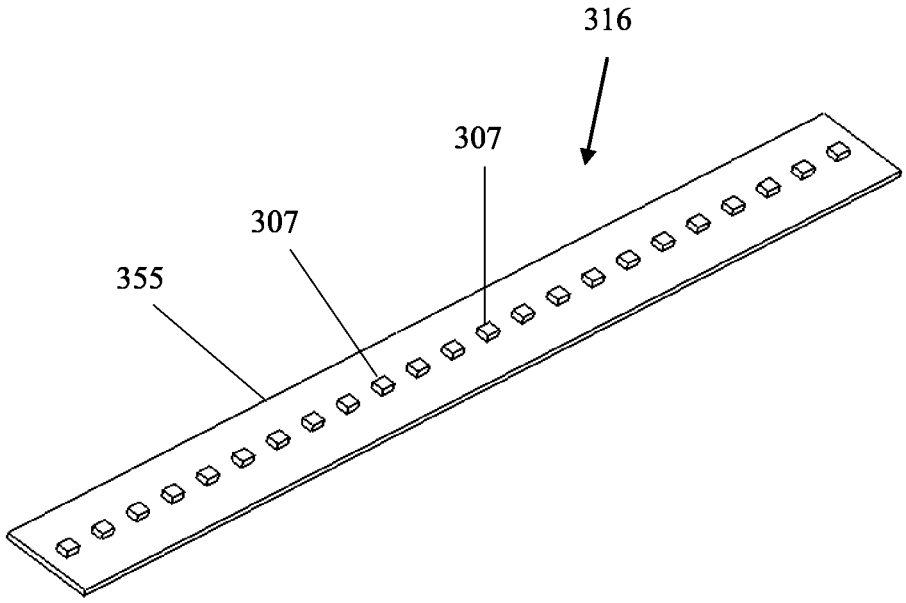
FIG. 7 is an LED light strip used in an LED luminaire according to the present disclosure.
Figure 8:
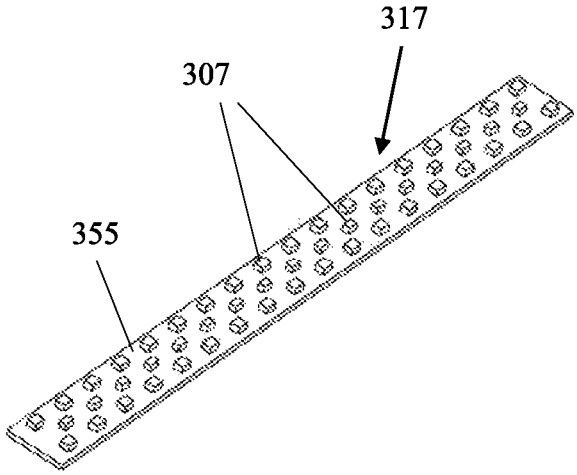
FIG. 8 is another embodiment of an LED light strip used in an LED luminaire according to the present disclosure.

FIG. 7 is an LED light strip used in an LED luminaire according to the present disclosure. As shown, an elongated LED light strip 316 comprises an LED printed circuit board (PCB) 355 and a plurality of LEDs 307 mounted in a single row. The plurality of LEDs 307 used may have different emission spectrum but of the same size, say 3528 type or other types. The plurality of LEDs 307 may be of one type of dedicated white LEDs having a CCT from 2,700 to 6,000 K. As mentioned above, RGB color mixing is promising in decorative lighting applications in which more colorful light is desired. In this case, a plurality of RGB LEDs may be used in the LED light strip 316. The LED luminaire according to the present disclosure is capable of seamlessly smoothing out colorful light emissions such that no color shadows can be seen. By varying the intensities of the individual red, green, and blue light sources, any colorful light emissions that human eyes can perceive can be obtained. For a demonstration purpose, the length of the LED PCB 355 is shorter than that of the real one, so as in FIGS. 8-11. FIG. 8 is another embodiment of an LED light strip used in an LED luminaire according to the present disclosure. The LED light strip 317 comprises a plurality of LEDs 307. The LEDs 307 used are the same as in FIG. 7, so as the LED PCB 355, except that the LEDs 307 are arranged in three rows with one row interlaced with the other two.

Figure 9:
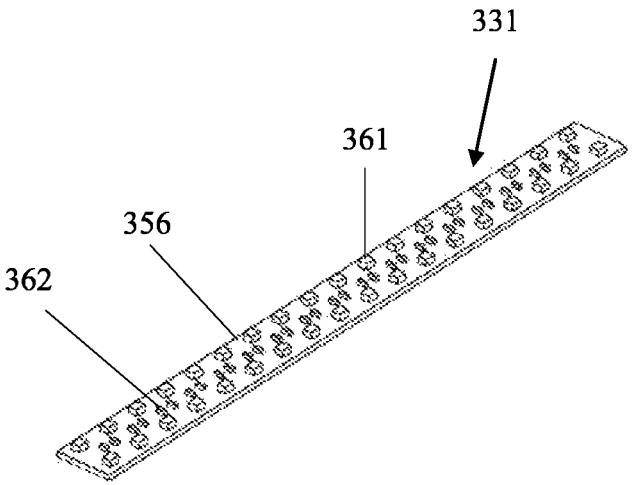
FIG. 9 is an LED light strip used in an LED module when a tunable CCT is needed according to the present disclosure.
Figure 10:
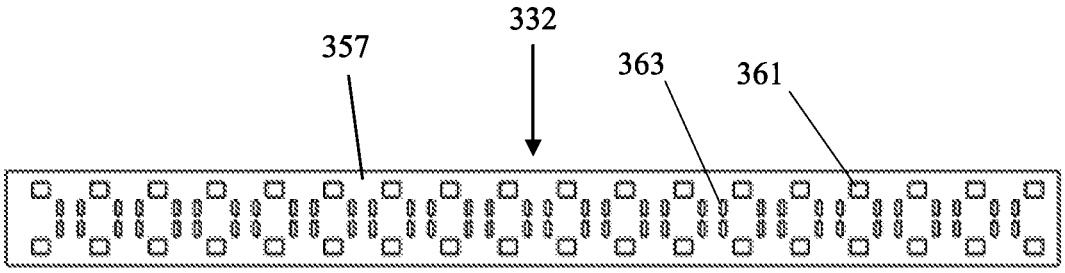
FIG. 10 is another embodiment of an LED light strip used in an LED module when a tunable CCT is needed according to the present disclosure.
Figure 11:
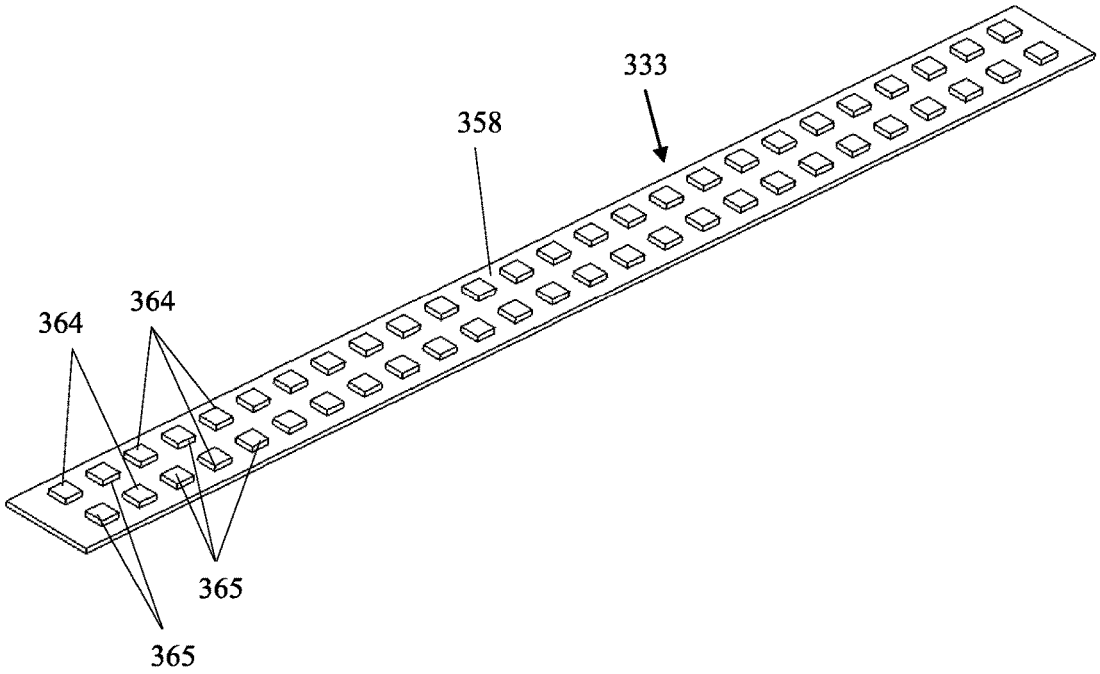
FIG. 11 is an LED light strip used in an LED module when two different whites LEDs are used in a tunable CCT application according to the present disclosure.

FIGS. 9 and 10 show two LED light strips 331 and 332 that may be used on the central flat mount surface portion when a tunable CCT is needed. As shown in FIG. 9, the LED light strip 331 comprises a first type of the white LEDs 361 having a CCT at 6,200±300 K and a second type of LEDs 362 having a saturated color at a peak wavelength from 583 to 586 nm, mounted on an LED PCB 356. The white LEDs 361 of the first type are arranged in two rows, and every four consecutive white LEDs 361 of the first type from the two rows encircle two LEDs 362 of the second type to have CCTs tunable from 2,700 to 6,000 K, depending on a ratio of electric currents supplied to the two types of LEDs. FIG. 10 has a similar structure except that four relatively smaller second type of LEDs 363 are surrounded by four first type of the white LEDs 361, mounted on an LED PCB 357 in the LED light strip 332. FIG. 11 shows an LED light strip 333 that may be used in the LED luminaire when a tunable CCT is needed according to the present disclosure. Two kinds of phosphor coated white LEDs, one cool white and the other warm white, are used to mix the light emissions with different ratios to come up with desired CCTs. A plurality of LEDs mounted on an LED PCB 358 in the LED light strip 333 comprise a first type of white LEDs 364 having a CCT at 5,700±300 K and a second type of white LEDs 365 having a CCT at 2,700±300 K, and wherein the white LEDs 364 of the first type are interlaced two-dimensionally with the white LEDs 365 of the second type, no matter how many rows there are. As shown, there is one first type of white LEDs 364 arranged in between every two second type of white LEDs 365, or vice versa. In two-row application, if the first white LED in the first row is of the first type, then the first white LED in the second row is of the second type. They are not necessarily aligned collinearly. Although only two rows of the plurality of LEDs are shown in FIG. 11, there may be one row, three rows, or more rows in this application.

Whereas preferred embodiments of the present disclosure have been shown and described, it will be realized that alterations, modifications, and improvements may be made thereto without departing from the scope of the following claims. Another design or mechanisms in an LED troffer or luminaire using various kinds of combinations to accomplish the same or different objectives could be easily adapted for use from the present disclosure. Accordingly, the foregoing description and attached drawings are by way of example only, and are not intended to be limiting.

What is claimed is:

1. A light-emitting diode (LED) luminaire, comprising:

a body having an internal surface comprising two side surface portions, two end surface portions, and a central flat mount surface portion connected to the two side surface portions and the two end surface portions;

a reflector on the internal surface of the body, the reflector comprising two side reflectors on the two side surface portions of the internal surface of the body, an upper reflector on the central flat mount surface portion connected between the two side reflectors, and two end reflectors on the two end surface portions of the internal surface of the body, wherein the upper reflector is at an angle in a range from 90° to 180° relative to the two side reflectors;

at least one LED light strip mounted on the central flat mount surface portion, the at least one LED light strip having a plurality of LEDs thereon; and a light exit window between the two side surface portions of the internal surface of the body, the light exit window comprising long, narrow cuts aligned in a lengthwise direction of the at least one LED light strip, wherein the internal surface of the body and the light exit window define an interior cavity symmetric with respect to a vertical plane passing through a center line of the internal surface;

wherein the long, narrow cuts comprise a corrugated structure; and wherein the plurality of LEDs emit light rays onto the light exit window with light images overlapping one another so as to smooth out hot spots with dark spots.

2. The LED luminaire of claim 1, wherein the reflector further comprises a diffuser with a white reflective material having 8% absorption or less.

3. The LED luminaire of claim 1, wherein the light exit window comprises a diffuser.

4. The LED luminaire of claim 1, wherein the light exit window comprises a lens.

5. The LED luminaire of claim 4, wherein the lens has a convex shape.

6. The LED luminaire of claim 1, wherein the two side surface portions have a concave shape.

7. The LED luminaire of claim 1, wherein each of the two end surface portions comprises a securing mechanism configured to secure the light exit window.

8. The LED luminaire of claim 1, wherein the light exit window further comprises two hanging portions integrated on two sides of the light exit window.

9. The LED luminaire of claim 1, wherein the plurality of LEDs on the at least one LED light strip comprise a first type of white LEDs having a correlated color temperature (CCT) at 6,200±300 K and a second type of LEDs having a saturated color at a peak wavelength from 583 to 586 nm, wherein the white LEDs of the first type are arranged in two rows, and wherein every four consecutive white LEDs of the first type from the two rows encircle four LEDs of the second type.

10. The LED luminaire of claim 1, wherein the plurality of LEDs on the at least one LED light strip comprise white LEDs having a correlated color temperature (CCT) from 2,700 to 6,000 K.

11. The LED luminaire of claim 1, wherein the plurality of LEDs on the at least one LED light strip comprise a first type of white LEDs having a correlated color temperature (CCT) at 5,700±300 K and a second type of white LEDs having a CCT at 2,700±300 K, and wherein the LEDs of the first type are interlaced with the LEDs of the second type.

12. The LED luminaire of claim 1, wherein the plurality of LEDs on the at least one LED light strip comprise red, green, and blue (RGB) LEDs.

13. The LED luminaire of claim 1, wherein the LED luminaire further comprises an LED light strip on the upper reflector configured to operate when alternating-current (AC) mains are unavailable, and wherein the LED light strip comprises at least one LED thereon.

* * * * *